US008143991B2

(12) United States Patent
Yang

(10) Patent No.: US 8,143,991 B2
(45) Date of Patent: Mar. 27, 2012

(54) CURRENT AND TEMPERATURE OVERLOADING PROTECTION DEVICE

(76) Inventor: Chin-Chi Yang, Wufong Hsiang (TW)

( * ) Notice: Subject to any disclaimer, the term of this patent is extended or adjusted under 35 U.S.C. 154(b) by 166 days.

(21) Appl. No.: 12/458,054

(22) Filed: Jun. 30, 2009

(65) Prior Publication Data

US 2010/0328017 A1 Dec. 30, 2010

(51) Int. Cl.
*H01H 85/36* (2006.01)
*H01H 37/76* (2006.01)

(52) U.S. Cl. ..... 337/407; 337/239; 337/401; 337/404; 337/186

(58) Field of Classification Search ..... 337/186, 337/401, 407, 239, 404
See application file for complete search history.

(56) References Cited

U.S. PATENT DOCUMENTS

| | | | | | |
|---|---|---|---|---|---|
| 2,704,797 | A * | 3/1955 | Fettweis | 337/405 |
| 2,790,049 | A * | 4/1957 | McAlister | 337/405 |
| 3,198,914 | A * | 8/1965 | Baran et al. | 337/405 |
| 3,763,454 | A * | 10/1973 | Zandonatti | 337/404 |
| 4,433,231 | A * | 2/1984 | Balchunas | 219/253 |
| 4,536,641 | A * | 8/1985 | Chan | 219/253 |
| 5,192,937 | A * | 3/1993 | Lee | 337/104 |
| 5,254,969 | A * | 10/1993 | Caddock, Jr. | 338/308 |
| 5,280,262 | A * | 1/1994 | Fischer | 337/405 |
| 5,600,295 | A * | 2/1997 | Kaufmann | 337/405 |
| 5,612,662 | A * | 3/1997 | Drekmeier et al. | 337/389 |
| 5,770,993 | A * | 6/1998 | Miyazawa et al. | 337/160 |
| 5,793,274 | A * | 8/1998 | Kelly et al. | 337/183 |
| 5,896,080 | A * | 4/1999 | Chen | 337/407 |
| 6,088,234 | A * | 7/2000 | Ishikawa et al. | 361/760 |
| 6,348,851 | B1 * | 2/2002 | Wyser et al. | 337/411 |
| 6,583,711 | B2 * | 6/2003 | Yang | 337/394 |
| 6,664,885 | B2 * | 12/2003 | Bromley et al. | 337/104 |
| 7,385,474 | B2 * | 6/2008 | Kawanishi | 337/142 |
| 7,864,024 | B2 * | 1/2011 | Schlenker et al. | 337/407 |
| 2011/0050384 | A1 * | 3/2011 | Chen et al. | 337/296 |

* cited by examiner

*Primary Examiner* — Anatoly Vortman
(74) *Attorney, Agent, or Firm* — Bacon & Thomas, PLLC

(57) ABSTRACT

A current and temperature overload protection device has a brace, a thermal sensing contact, a solder layer, two ports and two resilient elements. The thermal sensing contact, the solder layer, the two ports and the two resilient elements are mounted on the brace, where each resilient element is bent to connect between respective ports and the thermal solder layer. The current and temperature overload protection device is mounted on a circuit board connected in a circuit loop of the circuit board, and the thermal sensing contact is connected to a heat-generating device. Therefore, the current and temperature overload protection device provides protection to the circuit loop from thermal and current overload issues.

4 Claims, 3 Drawing Sheets

CURRENT AND TEMPERATURE OVERLOADING PROTECTION DEVICE

BACKGROUND OF THE INVENTION

1. Field of Invention

The present invention relates to an electric current overload protection device, and more particular to a protection device that is also capable of detecting and preventing circuit failure due to high temperature.

2. Description of the Related Art

With reference to FIG. 5, an overload protection device used for an electric circuit board has a brace (90), two ports (92), a temperature sensing element (93), a knife-break switch (94), and a current overload fuse (96). The two ports (92) are separately mounted on the brace (90). The temperature sensing element (93) is a rod made from a high thermal expansion material and is mounted between the ports (92). The knife-break switch (94) is mounted between the two ports (92) and has a pivotal end and a distal end. The distal end of the knife-break switch (94) selectively contacts one of the ports (92). The pivotal end of the knife-break switch (94) is electronically connected to the other port (92) with using the current overload fuse (96). During use, the overload protection device is electrically connected in a circuit loop with the ports (92) and the temperature sensing element (93) is attached to a heat generating element of the circuit loop. Thus, the overload protection device may break thus to protect the circuit loop either when temperature abnormally increases or when the current overload occurs.

Although the aforementioned overload protection device may provide the circuit loop with the high temperature and overload current protection, the overload protection device still has disadvantages. For instance, an installation angle of the overload protection device is limited since the knife-break switch cannot function up side down. Moreover, many elements are required in the overload protection device, thus manufacturing complexity and costs are not satisfactory.

The present invention provides a current and temperature overload protection device that has a simplified structure without limitation to installation orientation.

SUMMARY OF THE INVENTION

The primary objective of the present invention is to provide a current and temperature overload protection device that is simple to manufacture without limitation to installation orientation.

The current and temperature overload protection device has a brace, a thermal sensing contact, a solder layer, two ports and two resilient elements. The thermal sensing contact, the solder layer, the two ports and the two resilient elements are respectively mounted on the brace, where each resilient element is bent to connect between one of the ports and the thermal solder layer. The current and temperature overload protection device is mounted on a circuit board to connect with a circuit loop of the circuit board, and the thermal sensing contact is connected to a heat-generating device. Therefore, the current and temperature overload protection device provides protections to the circuit loop from thermal and current overloads.

Other objectives, advantages and novel features of the invention will become more apparent from the following detailed description when taken in conjunction with the accompanying drawings.

DETAILED DESCRIPTION OF THE INVENTION

Figure 1:
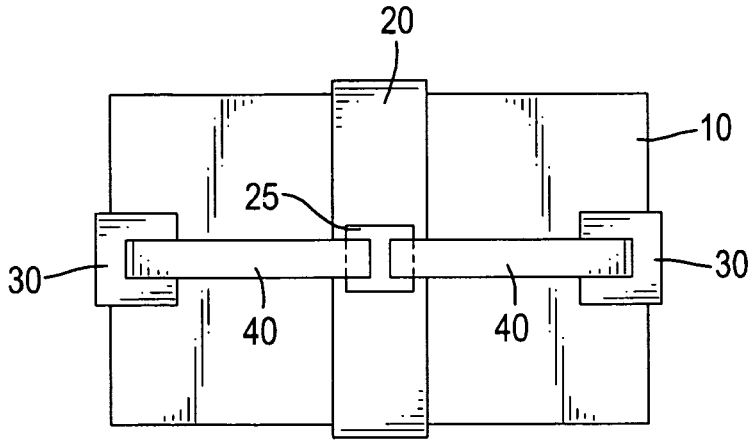
FIG. 1 is a top view of a current and temperature overload protection device in accordance with the present invention.
Figure 2:
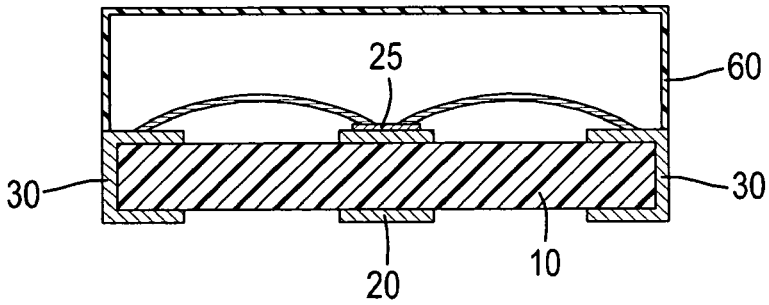
FIG. 2 is a cross sectional side view of the current and temperature overload protection device in FIG. 1, shown open.
Figure 3:
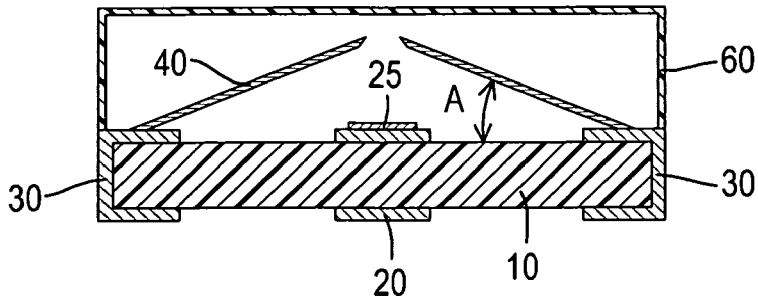
FIG. 3 is a cross sectional side view of the current and temperature overload protection device in FIG. 1, shown closed.

With reference to FIGS. 1, 2 and 3, a current and temperature overload protection device in accordance with the present invention comprises a brace (10), a thermal sensing contact (20), solder layer (25), two ports (30), two resilient elements (40) and may have a cover (60). The brace (10) is non-conductive, may be a printed circuit board (PCB), a plastic disc, a ceramic disc or the like and has a top surface and a bottom surface.

The thermal sensing contact (20) is thermally conductive and is mounted on the top and bottom surface of the brace (10). The thermal sensing contact (20) may be mounted through the brace (10), thereby contacting the top and bottom surfaces of the brace (10), or may be a band-like thermally conductive material that is mounted around the brace (10).

The solder layer (25) is sheet like, is electrically conductive, is low temperature melting and is mounted on the thermal sensing contact (20) corresponding to the top surface of the brace (10). The solder layer (25) may be Tin or Tin-alloy, which has a relatively low melting temperature at around 250 to 400 degrees centigrade.

The two ports (30) are electrically conductive, are mounted on the top and bottom surfaces of the brace (10) and are separated from the thermal sensing contact (20).

The two resilient elements (40) are electrically conductive, are rod-like, maybe made of stainless steel, copper, copper-alloy or the like and each resilient element (40) has two ends. The resilient elements (40) are bent and the ends of the resilient elements (40) are respectively mounted on and electrically connected to the solder layer (25) and respective ports (30). Thus, the ports (30) are electrically connected to each other by the resilient elements (40) and the solder layer (25). When the solder layer (25) melts, one end of each resilient element (40) is released from the solder layer (25) so the resilient elements (40) extend and disconnect the two ports (30).

The cover (60) is non-conductive, is shaped corresponding to the brace (10) and covers the top surface of the brace (10) to protect elements on the top layer of the brace (10).

Figure 4:
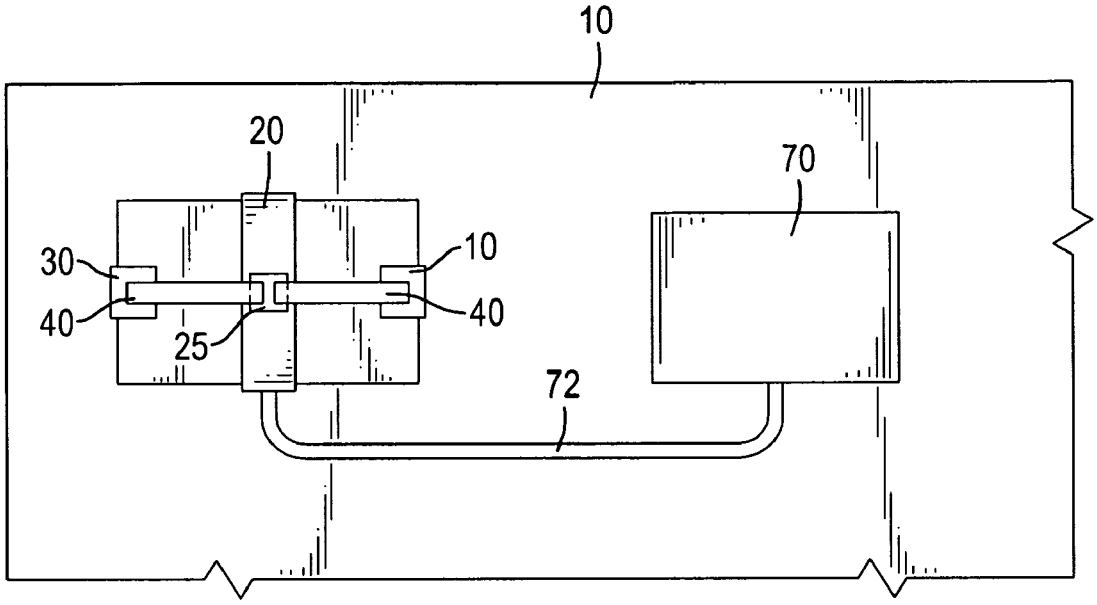
FIG. 4 is an operational top view of the current and temperature overload protection device in FIG. 1.
Figure 5:
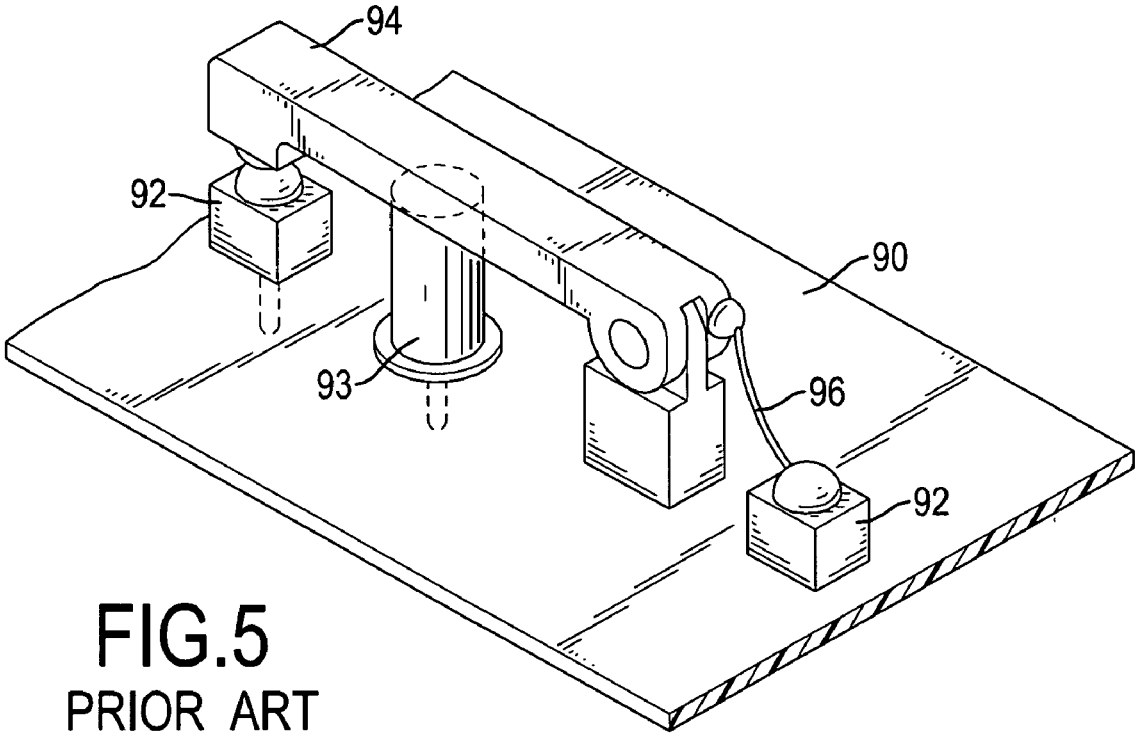
FIG.5 PRIOR ART
FIG. 5 is a perspective view of a conventional overload protection device in accordance with the prior art.

As described above, the disclosed current and temperature overload protection device is a kind of a surface mount device (SMD). Therefore, the ports (30) on the bottom surface of the brace (10) may be mounted on a circuit board so as to be connected with a circuit loop in the circuit board. With reference to FIG. 4, the thermal sensing contact (20) is located adjacent to or directly contacts to a heat-generating element (70) of the circuit board or may be connected to the heat-generating element (70) through a heat pipe (72). Thus, the current and temperature overload protection device is capable of protecting the circuit loop from failure due to thermal burn out or current overload, since the solder layer (25) melts by the heat generated from the heat-generating element (70) or the current passing therethrough.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A current and temperature overload protection device comprising a brace made of a non-conductive material and having a flat top surface and a bottom surface;

a thermal sensing contact made of a thermally conductive material and mounted on the flat top and bottom surfaces of the brace;

an electrically conductive solder layer mounted on the thermal sensing contact at a position corresponding to the flat top surface of the brace;

two ports made of an electrically conductive material, mounted on the flat top and bottom surfaces of the brace and separated from the thermal sensing contact;

two resilient elements made of an electrically conductive material and each resilient element having two ends, wherein each resilient element is bent and spaced from the flat top surface of the brace and the ends of the resilient elements are mounted on and electrically connected to the solder layer and a respective one of the ports; and a cover made of non-conductive material, shaped corresponding to the brace and covering the flat top surface of the brace, wherein the brace is a printed circuit board, a plastic disc or a ceramic disc; and the thermal sensing contact is a band-like thermally conductible material that is mounted around the brace and contacts the top and bottom surfaces of the brace.

2. The current and temperature overload protection device as claimed in claim 1, wherein the solder layer is made of Tin or Tin-alloy.

3. The current and temperature overload protection device as claimed in claim 1, wherein the resilient elements are made of stainless steel, copper or copper-alloy.

4. The current and temperature overload protection device as claimed in claim 2, wherein the resilient elements are made of stainless steel, copper or copper-alloy.

* * * * *